US011752413B2

(12) United States Patent
Glancy

(10) Patent No.: US 11,752,413 B2
(45) Date of Patent: Sep. 12, 2023

(54) ARTICLE OF FOOTWEAR WITH MULTIPLE DUROMETER OUTSOLE AND DIRECTIONAL CLEAT PATTERN

(71) Applicant: Under Armour, Inc., Baltimore, MD (US)

(72) Inventor: Michael Glancy, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 45 days.

(21) Appl. No.: 15/850,769

(22) Filed: Dec. 21, 2017

(65) Prior Publication Data

US 2018/0185731 A1 Jul. 5, 2018

Related U.S. Application Data

(60) Provisional application No. 62/441,180, filed on Dec. 31, 2016.

(51) Int. Cl.
*A43B 13/22* (2006.01)
*A43B 5/00* (2022.01)
(Continued)

(52) U.S. Cl.
CPC ..... *A63B 69/3667* (2013.01); *A43B 5/001* (2013.01); *A43B 13/22* (2013.01);
(Continued)

(58) Field of Classification Search
CPC ..... A43C 15/168; A43C 15/00; A43C 15/162; A43C 15/02; A43B 13/023; A43B 13/12;
(Continued)

(56) References Cited

U.S. PATENT DOCUMENTS 4,642,917 A * 2/1987 Ungar ..... A43C 15/162 36/59 C
5,367,791 A * 11/1994 Gross ..... A43B 13/26 36/31

(Continued)

FOREIGN PATENT DOCUMENTS

MX 2015007118 A 3/2016

OTHER PUBLICATIONS

PCT International Search Report and the Written Opinion, PCT/US/2017/067903, dated May 31, 2018, 7 pages.

*Primary Examiner* — Sharon M Prange
*Assistant Examiner* — Uyen T Nguyen
(74) *Attorney, Agent, or Firm* — Edell, Shapiro & Finnan, LLC

(57) ABSTRACT

The present invention is directed toward an article of footwear that effectively reduces rotation the article of footwear during a golf swing. The article of footwear includes an upper and a sole structure, where the sole structure is comprised of a midsole, a first outsole, and a second outsole. The article of footwear includes a forefoot region, a midfoot region, and a hindfoot region. The first outsole is coupled to both the midsole and the second outsole, while the second outsole is disposed between the midsole and the first outsole. The second outsole includes a first series of lugs disposed along a lateral edge of the second outsole and extending through the first outsole in the forefoot region, and a second series of lugs disposed along a medial edge of the second outsole and extending through the first outsole in the hindfoot region.

10 Claims, 13 Drawing Sheets

(51) Int. Cl.
*A43C 15/16* (2006.01)
*A43C 15/02* (2006.01)
*A63B 69/36* (2006.01)

(52) U.S. Cl.
CPC ..... *A43C 15/162* (2013.01); *A43C 15/168* (2013.01); *A43C 15/02* (2013.01)

(58) Field of Classification Search
CPC ... A43B 13/122; A43B 13/125; A43B 13/127; A43B 13/14; A43B 13/141; A43B 13/143; A43B 13/22; A43B 13/223; A43B 13/24; A43B 13/26; A43B 5/001; A43B 5/00
USPC ..... 36/103, 114
See application file for complete search history.

(56) References Cited

U.S. PATENT DOCUMENTS 5,943,794 A * 8/1999 Gelsomini ..... A43B 13/26 36/67 R
9,210,967 B2 * 12/2015 Gerber ..... A43C 15/161
10,010,136 B2 * 7/2018 Shaffer ..... A43B 7/1445
2002/0184793 A1 * 12/2002 Sato ..... A43B 13/12 36/114
2007/0199211 A1 * 8/2007 Campbell ..... A43B 13/141 36/102
2009/0126230 A1 * 5/2009 McDonald ..... A43B 9/00 36/103
2011/0192056 A1 * 8/2011 Geser ..... A43B 13/26 36/114
2012/0036740 A1 * 2/2012 Gerber ..... A43B 13/26 36/134
2012/0066933 A1 * 3/2012 Meythaler ..... A43B 13/141 36/134
2012/0233886 A1 * 9/2012 Madore ..... A43B 5/001 36/103
2013/0340295 A1 * 12/2013 Adami ..... A43B 13/16 36/25 R
2014/0237852 A1 * 8/2014 Oberschneider ..... A43B 5/001 36/62
2014/0283413 A1 * 9/2014 Christensen ..... A43B 13/20 36/102
2015/0075033 A1 3/2015 Cross et al.
2015/0313312 A1 * 11/2015 Park ..... A43B 13/16 36/31
2016/0227878 A1 8/2016 Lan
2016/0255911 A1 * 9/2016 Fujita ..... A43B 13/12
2016/0302523 A1 * 10/2016 Fujita ..... A43B 13/122
2017/0079373 A1 * 3/2017 Huard ..... A43B 7/144
2017/0119091 A1 * 5/2017 Bischoff ..... A43B 13/188

* cited by examiner

ARTICLE OF FOOTWEAR WITH MULTIPLE DUROMETER OUTSOLE AND DIRECTIONAL CLEAT PATTERN

CROSS-REFERENCE TO RELATED APPLICATIONS

This application claims priority under 35 U.S.C. 119(e) to U.S. Provisional Patent Application Ser. No. 62/441,180, entitled "Article of Footwear with Multiple Durometer Outsole and Directional Cleat Pattern," filed Dec. 31, 2016, the disclosure of which is incorporated herein by reference in its entirety for all purposes.

FIELD OF THE INVENTION

The present invention relates to an article of footwear with a dual durometer outsole that increases traction.

BACKGROUND OF THE INVENTION

During a golf swing, a golfer rotates their hips, swings their arms, and shifts their weight, altering how their weight is distributed on their feet. These movements of the golfer during the golf swing leads to the rotation of the feet in place. More specifically, the lead foot of the golfer (e.g., the left foot of the right handed golfer) wants to rotate such that the toe end rotates in the lateral direction while the heel end rotates in the medial direction. Golf shoes with sole structures that fail to properly account for this rotation may allow the feet of golfers to rotate, creating bad golf shots, and possibly even causing discomfort (e.g., blisters from repeated rotation, twisted ankles, pulled muscles, etc.).

Accordingly, it would be desirable to provide an article of footwear with a sole structure that is effective to prevent the rotation of the feet during a golf swing while also providing proper traction during other phases of a golf game.

SUMMARY OF THE INVENTION

The present invention is directed toward an article of footwear with a sole structure having a dual durometer outsole. In an embodiment, the outsole may be constructed of a first outsole portion that is compressible and a second outsole portion that is incompressible. The first outsole portion includes a plurality of compressible lugs, while the second outsole portion includes a plurality of incompressible lugs. In addition, the incompressible lugs are disposed on the lateral edge of the forefoot region and the medial edge of the hindfoot region. The incompressible lugs may be shaped like wedges, and are configured prevent rotation of the feet (e.g., the toe end rotating in the lateral direction and the heel end rotating in the medial direction), which occurs during a golf swing.

In addition, the compressible lugs are configured to compress when a force is imparted on the ends. The compressible lugs are further configured to bend. Thus, the compressible lugs enable better traction of the article of footwear by keeping the first outsole portion in contact with the ground/support surface for a longer amount of time through compression or bending (e.g., during various phases of a typical gait, shifting the weight of the user to different portions of the foot, etc.). In operation, the sole structure of the article of footwear is effective to increase the traction and prevent the rotation of the article of footwear during a golf swing.

In an embodiment, an article of footwear includes an upper, a midsole, a first outsole and a second outsole. The upper may define a cavity, while the midsole may be coupled to the upper. The first outsole may include a top surface and a bottom surface, where the top surface is coupled to the midsole. The first outsole may further comprise a forefoot region, a midfoot region, and a hindfoot region. The second outsole may be disposed between the midsole and the top surface of the first outsole. The second outsole may comprise a first series of lugs that are disposed along a lateral edge of the second outsole and that extend through the first outsole in the forefoot region. Furthermore, the second outsole may also include a second series of lugs that are disposed along a medial edge of the second outsole and that extend through the first outsole in the hindfoot region.

In another embodiment, an article of footwear includes an upper, a midsole, and an outsole. The upper may define a cavity, while the midsole may be coupled to the upper. The outsole may be coupled to the midsole, and the outsole may further include a first series of lugs and a second series of lugs. The first series of lugs may be disposed along a lateral edge of the outsole in a forefoot region of the article of footwear. Conversely, the second series of lugs may be disposed along a medial edge of the outsole in a hindfoot region of the article of footwear. The first series of lugs may be configured to obstruct the forefoot region of the article of footwear from rotating in a lateral direction, while the second series of lugs may be configured to obstruct the hindfoot region of the article of footwear from rotating in a medial direction.

In yet another embodiment, an article of footwear includes an upper, a midsole, a first outsole and a second outsole. The upper may define a cavity, while the midsole may be coupled to the upper. The first outsole may include a top surface and a bottom surface, where the top surface is coupled to the midsole. The first outsole may further comprise a forefoot region, a midfoot region, and a hindfoot region. The first outsole may also be constructed with a first durometer value. The second outsole may be disposed between the midsole and the top surface of the first outsole. The second outsole may be constructed with a second durometer value that differs from the first durometer value. Furthermore, the first outsole may include a first set of lugs disposed in the forefoot, midfoot, and hindfoot regions, while the second outsole may include a second set of lugs that extend through the first outsole in the forefoot and hindfoot regions.

BRIEF DESCRIPTION OF THE DRAWINGS

Like reference numerals have been used to identify like elements throughout this disclosure.

DETAILED DESCRIPTION OF THE INVENTION

Figure 1A:
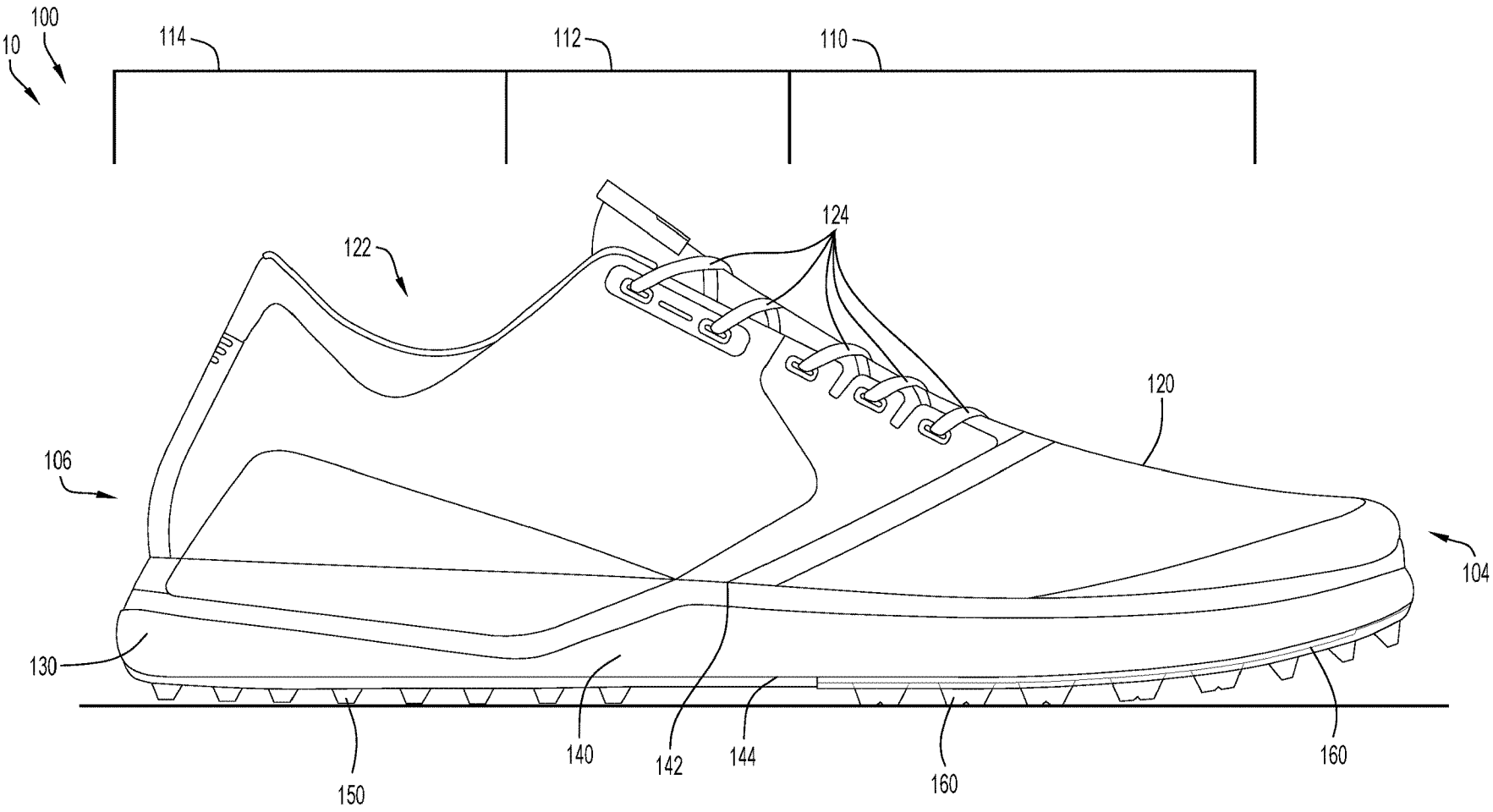
FIG. 1A illustrates a side elevational view of an embodiment of an article of footwear according to the present invention.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment," "an embodiment," "an exemplary embodiment," and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

An article of footwear or shoe 10 includes a lateral side 100 oriented along the lateral or little toe side of the user's foot, a medial side 102 oriented along the medial or big toe side of the user's foot, a toe (i.e., front) end 104 that corresponds with the toes of the user's foot, and a heel (i.e., rear) end 106 that corresponds with the heel of the user's foot. While the example embodiment depicted in the FIGS. 1A, 1B, 2A, 2B, 2C, 2D, 3A, 3B, 3C, 3D, 4A, 4B, 5A, and 5B shows an article of footwear 10 configured for a right foot, it is noted that the same or similar features can also be provided for an article of footwear 10 configured for a left foot (where such features of the right footed article of footwear are a reflection or "mirror image" symmetrical in relation to a left footed article of footwear).

The article of footwear 10 may include a forefoot region 110 that generally aligns with the ball and toes of a user's foot (i.e., when a user is wearing the article of footwear 10), a midfoot region 112 that generally aligns with the arch and instep areas of the user's foot, and a hindfoot region 114 that generally aligns with the heel and ankle areas of the user's foot. The embodiment of the article of footwear 10 illustrated includes an upper 120 and a sole structure 130. The article of footwear 10 illustrated in FIGS. 1A, 1B, 2A, 2B, 2C, 2D, 3A, 3B, 3C, 3D, 4A, 4B, 5A, and 5B may be utilized and applied for use in a golf shoe. Other embodiments of the article of footwear 10 illustrated in FIGS. 1A, 1B, 2A, 2B, 2C, 2D, 3A, 3B, 3C, 3D, 4A, 4B, 5A, and 5B may be utilized and applied for use in any type of article of footwear, including, but not limited to, shoes, sneakers, boots, sandals, etc.

The upper 120 forms an envelope or pocket that, in cooperation with the sole structure 130, defines a foot cavity operable to house (i.e., cover and protect) the foot of the wearer of the article of footwear 10. The upper 120 may be constructed from various materials that are configured to conform and contour to a foot that is placed within the upper 120 of the article of footwear 10. In some embodiments, the various materials that may be used to construct the upper 120, include, but are not limited to, leather, synthetic leather, rubber, textile fabrics (e.g., breathable fabrics, mesh fabrics, synthetic fabrics), etc. One material used for the upper 120 may be configured to have a high degree of stretchability and compressibility, while another material used on the upper 120 may have a lower degree of stretchability and compressibility. The materials used on the upper 120 may be generally lightweight and flexible, and may be configured to provide comfort to the user and provide other desirable features. The materials used on the upper 120 may be configured to have desirable aesthetics and functional features that incorporate durability, flexibility, air permeability and/or other types of desirable properties to the upper 120. In one embodiment, the upper 120 may be formed of a high porosity material operable to permit the flow of fluid (e.g., air) therethrough. In another embodiment, the upper 120 may be formed of a low porosity material.

As further illustrated, a collar or opening 122 may be disposed in the hindfoot region 114 of the upper 120. The opening 122 provides access to the interior of the upper 120 and enables a foot of a wearer of the article of footwear 10 to be placed within the interior of the upper 120. In addition, a fastening element 124 may be threaded through at least a portion of the midfoot region 112 of the upper 120. The fastening element 124 may be utilized to secure or tighten the upper 120 around the foot disposed within the interior of the upper 120.

As further detailed below, the sole structure 130 includes a midsole 140 mounted on top of a first outsole 150 and a second outsole 160, the second outsole 160 being primarily disposed between the midsole 140 and the first outsole 150. The midsole 140 includes a top surface 142 and bottom surface 144. As illustrated in FIG. 1A, the upper 120 may be disposed and coupled to the top surface 142 of the midsole 140. In addition, and as further detailed below, the first and second outsoles 150, 160 may be disposed and coupled to the bottom surface 144 of the midsole 140. The midsole 140 may be formed of a compression material such as a foamed elastomer, e.g., an ethylene-vinyl acetate (EVA) foam.

Extending downwardly from the first and second outsoles 150, 160 are a plurality of lugs. As further detailed below, a first set of lugs 170 extend downwardly from the first outsole 150, while a second set of lugs 180 and a third set of lugs 190 extend downwardly from the second outsole 160. Because the second outsole 160 is primarily disposed between the midsole 140 and the first outsole 150, the second and third sets of lugs 180, 190 extend downwardly through the first outsole 150. The first set of lugs 170 are disposed over the bottom of the sole structure 130 in each of the forefoot region 110, midfoot region 112, and hindfoot region 114. The first set of lugs 170 may be arranged in a series of columns that span longitudinally along the length of the sole structure 130 from the toe end 104 to the heel end 106. The first set of lugs 170 may also be arranged in a series of rows that span across the bottom of the sole structure 130 in the transverse direction from the lateral side 100 to the medial side 102 of the article of footwear 10.

Figure 1B:
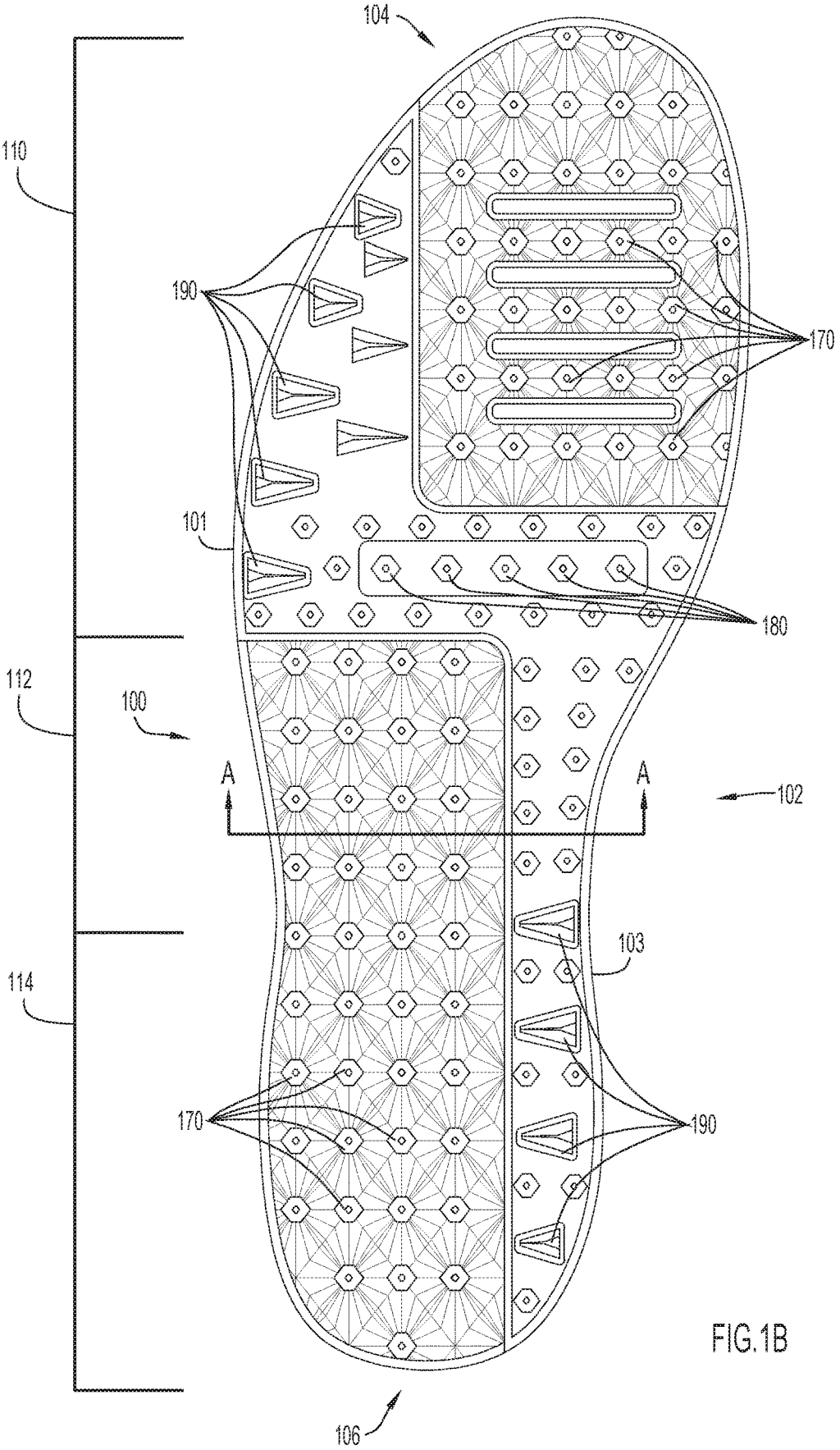
FIG. 1B illustrates a bottom view of the embodiment of the article of footwear illustrated in FIG. 1A.

In the embodiment illustrated in FIG. 1B, the second set of lugs 180 may be aligned in a lateral or transverse direction (e.g., from the lateral side 100 to the medial side 102 of the article of footwear 10) in a rearward area of the forefoot region 110 that is proximate to the transition from the forefoot region 110 to the midfoot region 112. Thus, the second set of lugs 180 may be aligned with the ball of a foot disposed within the article of footwear 10. In some embodiments, the second set of lugs 180 may be aligned both laterally and longitudinally with the first set of lugs 170 disposed around the second set of lugs 180.

The third set of lugs 190 are disposed in two different locations that are diametrically opposed from one another. In the first location, the third set of lugs 190 are disposed in the forefoot region 110 of the article of footwear 10 proximate to the outermost edge 101 of the sole structure 130 on the lateral side 100 of the article of footwear 10. In the second location, the third set of lugs 190 are disposed in the hindfoot region 114 of the article of footwear 10 proximate to the outermost edge 103 of the sole structure 130 on the medial side 102 of the article of footwear 10.

Figure 2A:
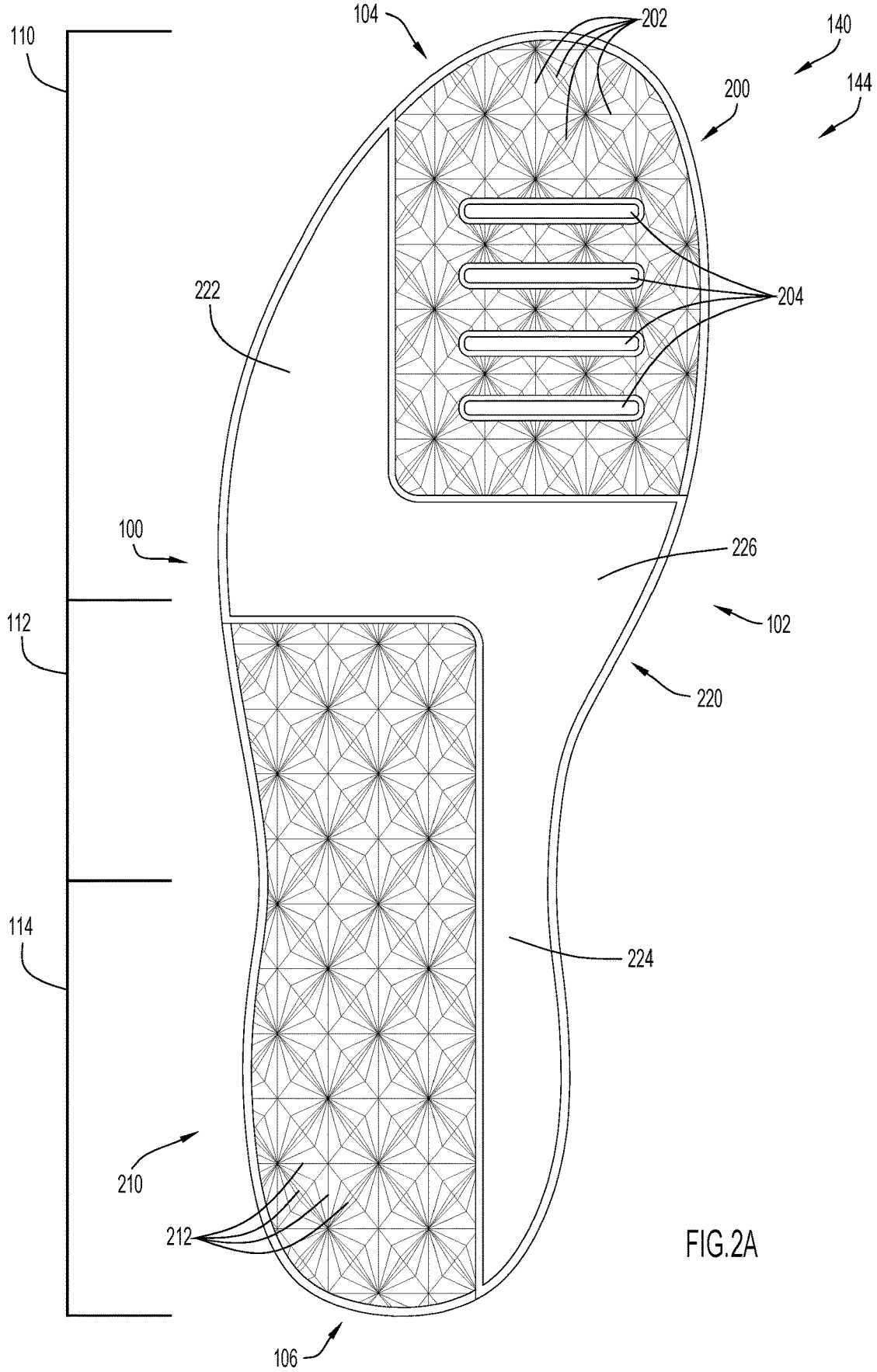
FIG. 2A illustrates a bottom view of the bottom surface of the midsole of the sole structure of the embodiment of the article of footwear illustrated in FIG. 1A.

The bottom surface 144 of the midsole 140 includes three sections 200, 210, 220. The first section 200 is disposed proximate to the toe end 104 and the medial side 102 of the midsole 140. Thus, as illustrated in FIG. 2A, the first section 200 is disposed within the forefoot region 110 of the article of footwear 10. The first section 200 includes a plurality of grooves 202 that create an undulating or multi-ridged surface within the first section 200. As illustrated, the grooves 202 extend through the first section 200 in the longitudinal direction (e.g., spanning from the toe end 104 towards the heel end 106), the transverse lateral direction (e.g., spanning from the medial side 102 towards the lateral side 100), and the diagonal direction (e.g., intersecting both the grooves 202 that span in the longitudinal direction and the grooves 202 that span in the transverse lateral direction). The first section 200 further includes a plurality of elongate protrusions 204. The elongate protrusions 204 are positioned within the first section 200 such that the elongate protrusions 204 extend in a transverse lateral direction across the bottom 144 of the midsole 140. The elongate protrusions 204 are disposed more proximate to the medial side 102 than the lateral side 100 of the midsole 140. The elongate protrusions 204 may extend beyond the ridges formed by the grooves 202 in the first section 200. Thus, in the first section 200, the thinnest portions of the midsole 140 are at the grooves 202, while the thickest portions of the midsole 140 are at the elongate protrusions 204.

The second section 210 of the bottom surface 144, as illustrated in FIG. 2A, is disposed proximate to the heel end 106 and the lateral side 100 of the midsole 140. The second section 210 of the bottom surface 144 is disposed within the heel region 114 and the midfoot region 112. Similar to the first section 200, the second section 210 includes a plurality of grooves 212 that create an undulating or multi-ridged surface within the second section 210. The grooves 212, similar to that of grooves 202, extend through the second section 210 in the longitudinal direction (e.g., spanning from the toe end 104 towards the heel end 106), the transverse lateral direction (e.g., spanning from the medial side 102 towards the lateral side 100), and the diagonal direction (e.g., intersecting both the grooves 212 that span in the longitudinal direction and the grooves 212 that span in the transverse lateral direction).

The third section 220 of the bottom surface 144 of the midsole 140 is disposed continuously through the forefoot region 110, the midfoot region 112, and the hindfoot region 114. The third section 220 of the bottom surface 144 includes three segments 222, 224, 226. The first segment 222 of the third section 220 is disposed proximate to the toe end 104 and spans longitudinally along the lateral side 100 of the bottom surface 144 such that the first segment 222 is disposed within the forefoot region 110 of the bottom surface 144. In addition, the first segment 222 is disposed laterally adjacent to the first section 200 of the bottom surface 144. Conversely, the second segment 224 is disposed proximate to the heel end 106 and spans longitudinally along the medial side 102 of the bottom surface 144 of the midsole 140 such that the second portion 224 is disposed in both the midfoot region 112 and the hindfoot region 114 of the midsole 140. The second segment 224 is disposed laterally adjacent to the second section 210 of the bottom surface 144 of the midsole 140. The third segment 226 of the third section 220 is disposed laterally (e.g., transverse to the longitudinal direction of the midsole 140) on the bottom surface 144 of the midsole 140 to connect the first segment 222 with the second segment 224. The third segment 226 may be disposed within the forefoot region 110 proximate to the transition of the forefoot region 110 to the midfoot region 112. As illustrated, the third portion 226 is disposed adjacent to both the first section 200 and the second section 210 of the bottom surface 144 of the midsole 140. Unlike the first section 200 and the second section 210, the third section 220 is substantially smooth and flat, and does not contain any grooves 202, 212 or ridges.

Figure 2B:
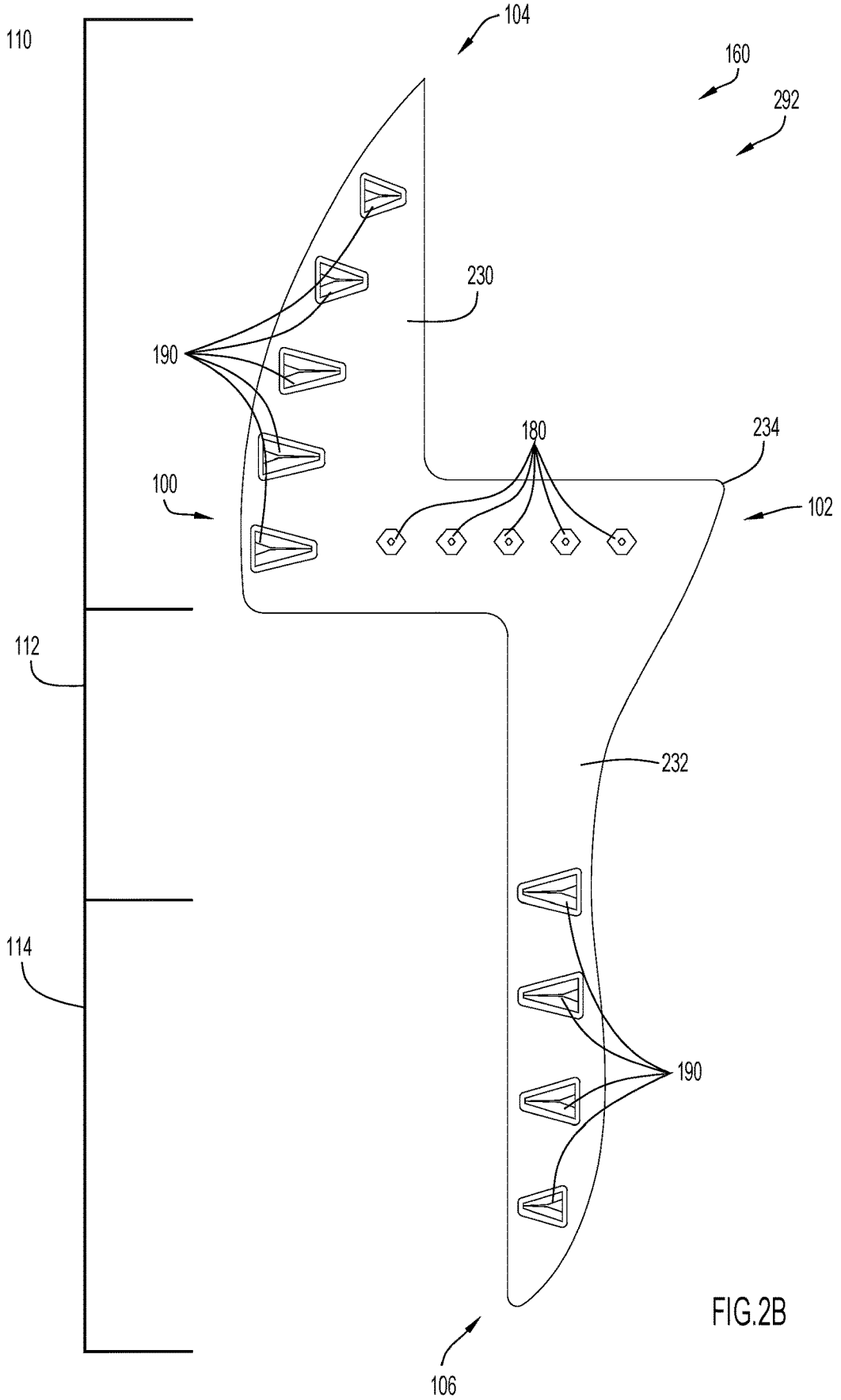
FIG. 2B illustrates a bottom view of the second outsole of the sole structure illustrated in FIG. 1B.

The second outsole 160, as illustrated in FIG. 2B, is shaped and sized substantially similar to that of the third section 220 of the bottom surface 144 of the midsole 140. Similar to the third section 220 of the bottom surface 144 of the midsole 140, the second outsole 160 includes a first segment 230, a second segment 232, and a third segment 234. The first segment 230 is disposed proximate to the toe end 104 and spans longitudinally along the lateral side 100 of the article of footwear 10. The first segment 230 is disposed within the forefoot region 110 of the article of footwear 10. Conversely, the second segment 232 is disposed proximate to the heel end 106 and spans longitudinally along the medial side 102 of the article of footwear 10. The second segment 232 is disposed in both the midfoot region 112 and the hindfoot region 114 of the article of footwear 10. The third segment 234 is oriented laterally (e.g., transverse to the longitudinal direction of the article of footwear 10) and connects the first segment 230 with the second segment 232. The third segment 234 may be disposed within the forefoot region 110 proximate to the transition of the forefoot region 110 to the midfoot region 112, and thus, the third segment 234 aligns with the ball of a foot disposed within the article of footwear 10.

As further illustrated, the first segment 230 includes a first series of the third set of lugs 190, which are disposed along the edge of the first segment 230 that spans along the lateral side 100 of the second outsole 160. Because the first segment 230 is disposed within the forefoot region 110 of the article of footwear 10, the third set of lugs 190 are also disposed in the forefoot region 110 of the article of footwear 10. The second segment 232 includes a second series of the third set of lugs 190, which are disposed along the edge of the second segment 232 that spans along the medial side 102 of the second outsole 230. In the embodiment illustrated in FIG. 2B, the third set of lugs 190 disposed on the second segment 232 are located only within the hindfoot region 114 of the article of footwear 10. However, in another embodiment, the third set of lugs 190 disposed on the second segment 232 may be located in both the midfoot region 112 and the hindfoot region 114. Finally, the second set of lugs 180 are laterally disposed along the third segment 234 such that the second set of lugs 180 also align with the ball of a foot disposed within the article of footwear 10.

The second outsole 160 may be constructed from a thermoplastic polyurethane (TPU) having a hard durometer. The second outsole 160 may further be constructed from a TPU that is colored and that has a degree of translucency such that the second outsole 160 is not completely opaque.

Figure 2C:
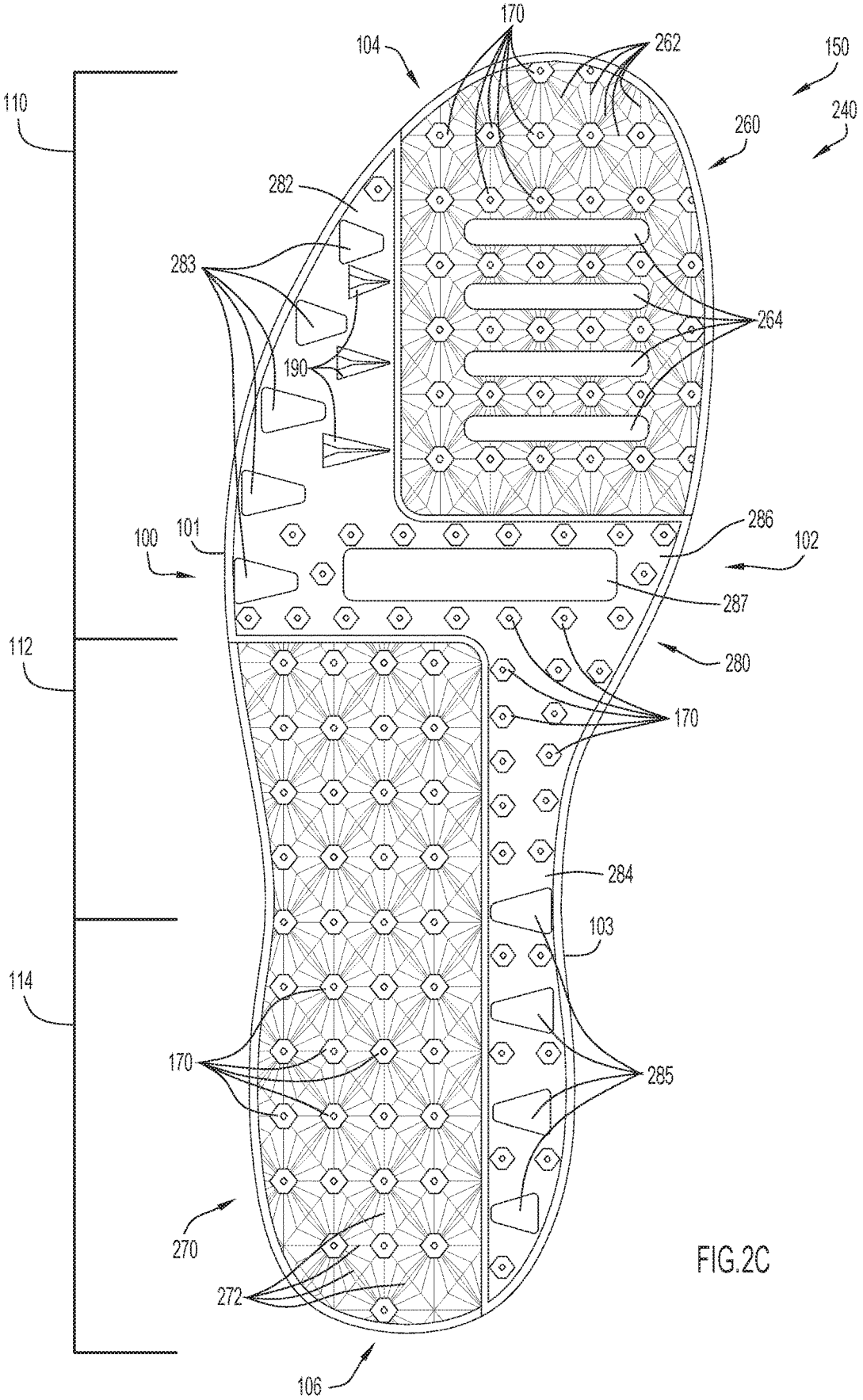
FIG. 2C illustrates a bottom view of the first outsole of the sole structure of the embodiment of the article of footwear illustrated in FIG. 1B.

The first outsole 150, as illustrated in FIG. 2C, may be constructed from a TPU having a durometer that is lower than the durometer of the second outsole 160. Thus, the first outsole 150 may be softer than the second outsole 160, where the first outsole 150 may have a degree of resiliency. The durometer of the first outsole 150 may enable the first outsole 150 to be compressible. Furthermore, the first outsole 150 may be clear in color, and thus more translucent than the second outsole 160. While FIG. 2C illustrates the bottom surface 240 of the first outsole 150, the features disposed on the top surface 250 (illustrated in FIG. 2D) of the first outsole 160 may be visible through the first outsole 150.

Similar to the bottom surface 144 of the midsole 140, the first outsole 150 may include three sections 260, 270, 280. The first sections 260 may be disposed in the forefoot region 110 of the first outsole 150 proximate to the toe end 104 and the medial side 102 of the first outsole 150. The first section 260 of the first outsole 150 may be sized and shaped substantially similar to the first section 200 of the bottom surface 144 of the midsole 140. Furthermore, the first outsole 150 includes a plurality of grooves 262 disposed in the top surface 250 of the first section 260 such that the plurality of grooves 252 create an undulating or multi-ridged top surface 250 within the first section 260 that complements the multi-ridged bottom surface 144 of first section 200 of the midsole 140 (i.e., the multi-ridged top surface 250 of the first section 260 of the first outsole 150 mates with the multi-ridged bottom surface 144 of first section 200 of the midsole 140). The first section 260 of the first outsole 150 further includes a plurality of elongate openings 264 that extend from the top surface 250 of the first outsole 150 to the bottom surface 240 of the first outsole 150. The elongate openings 264 are sized and shaped to be substantially similar to the elongate protrusions 204 of the bottom surface 144 of the midsole 140. Thus, when the first outsole 150 is mounted on the bottom surface 144 of the midsole 140, the elongate protrusions 204 extend at least partially through the elongate openings 264 of the first outsole 150.

The second section 270 of the first outsole 150 may be disposed in the midfoot and hindfoot regions 112, 114 proximate to the lateral side 100 of the first outsole 150. The second section 270 of the first outsole 150 may be sized and shaped substantially similar to the second section 210 of the bottom surface 144 of the midsole 140. The first outsole 150 includes a plurality of grooves 272 disposed in the top surface 250 of the second section 270 such that the plurality of grooves 272 create an undulating or multi-ridged top surface 250 within the second section 270 that complements the multi-ridged bottom surface 144 of second section 210 of the midsole 140 (i.e., the multi-ridged top surface 250 of the second section 270 of the first outsole 150 mates with the multi-ridged bottom surface 144 of second section 210 of the midsole 140).

The third section 280 of the first outsole 150 may be substantially similar in shape and size as the second outsole 160 and the third section 220 of the bottom surface 144 of the midsole 140. The third section 280 may span through the forefoot region 110, midfoot region 112, and hindfoot region 114. Similar to the second outsole 160 and the third section 220 of the midsole 140, the third section 280 of the first outsole 150 includes a first segment 282, a second segment 284, and a third segment 286. The first segment 282 of the third section 220 is disposed proximate to the toe end 104 and spans longitudinally along the lateral side 100 of the first outsole 150 within the forefoot region 110 of the first outsole 150. As illustrated, the first segment 282 includes a series of first openings 283 disposed along the outermost edge 101 on the lateral side 100. The first openings 283 are sized and shaped to be substantially similar to the third set of lugs 190 disposed along the first segment 230 of the second outsole 160. Conversely, the second segment 284 is disposed proximate to the heel end 106 and spans longitudinally along the medial side 102 of the first outsole 150 such that the second segment 284 spans through the midfoot and hindfoot regions 112, 114 of the first outsole 150. The second segment 284 includes a series of second openings 285 disposed along the outermost edge 103 on the medial side 102 in the hindfoot region 114. The second openings 285 are sized and shaped to be substantially similar to the second series of the third set of lugs 190 disposed along the second segment 232 of the second outsole 160. Finally, the third segment 286 of the third section 280 is disposed laterally (e.g., transverse to the longitudinal direction of the first outsole 150) on the first outsole 150 to connect the first segment 282 to the second segment 284. The third segment 286 further includes a substantially rectangular aperture 287. The aperture 287 is sized and shaped to receive the entire second set of lugs 180 of the second outsole 160.

As further illustrated in FIG. 2C, a plurality of the first set of lugs 170 are disposed on the bottom surface 240 of the first outsole 150. The first set of lugs 170 are disposed in each of the first section 260, second section 270, and third section 280 and are configured to extend substantially vertically from the bottom surface 240 of the first outsole 150. The first set of lugs 170 disposed in the first section 260 are arranged in a grid-like array such that the first set of lugs 170 are aligned with the intersection of the longitudinal, transverse, and diagonal grooves 262. Similarly, the first set of lugs 170 disposed in the second section 270 are arranged in a grid-like array such that the first set of lugs 170 are aligned with the intersection of the longitudinal, transverse, and diagonal grooves 272. The first set of lugs 170 disposed in the third section 280 are arranged around the first openings 283, the second openings 285, and the aperture 287. In some embodiments, the third set of lugs 190 may also extend from the bottom surface 240 of the first outsole 150. The third set of lugs 190 disposed on the bottom surface 240 of the first outsole 150 may be disposed in the first segment 282 of the third section 280, and proximate to the first set of openings 283.

Figure 2D:
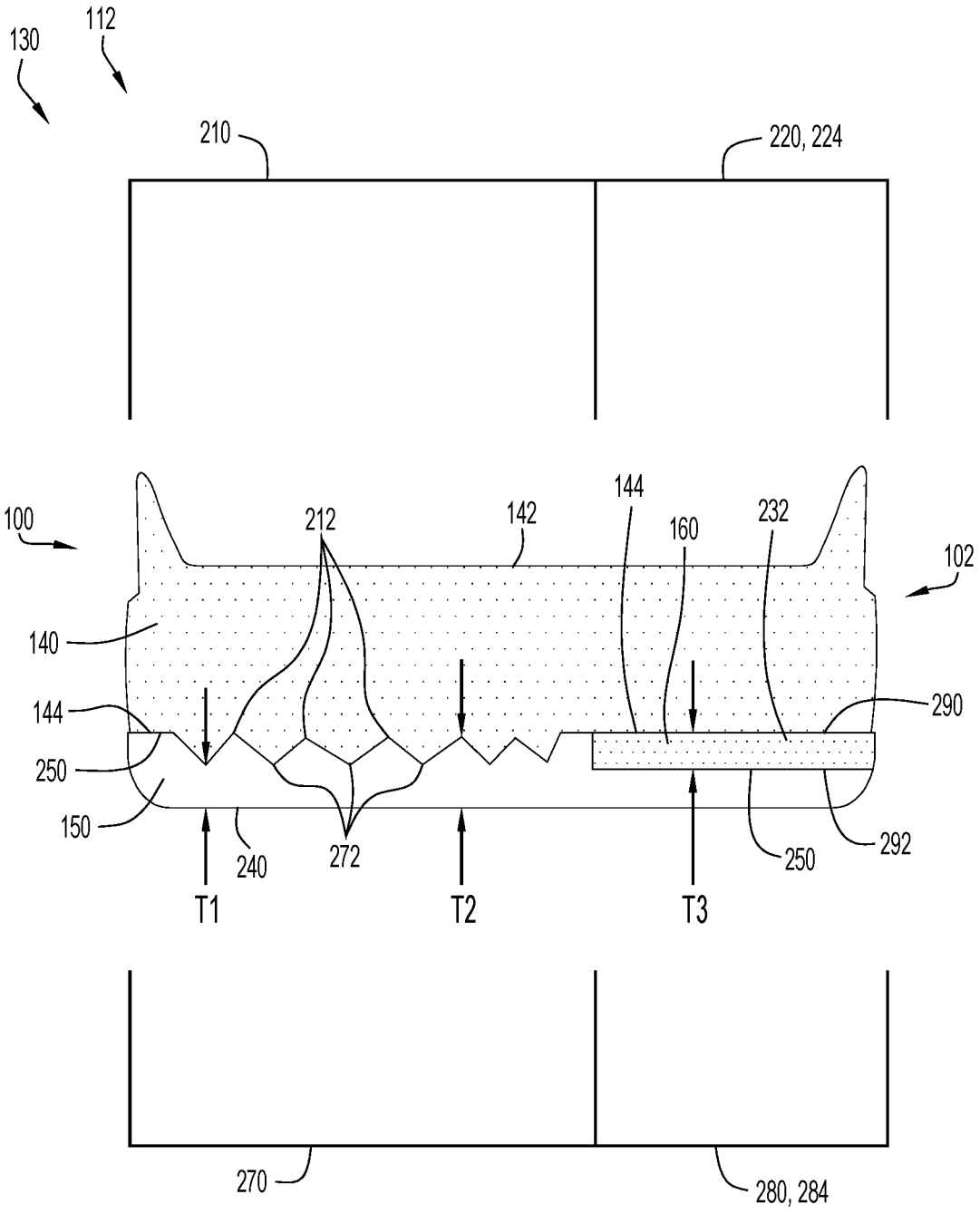
FIG. 2D illustrates a cross-sectional view of the sole structure of the embodiment of the article of footwear illustrated in FIG. 1B, the cross-section taken along line A-A in FIG. 1B.

As previously described herein, and as illustrated in FIG. 2D, the sole structure 130 is constructed of the midsole 140, the first outsole 150, and the second outsole 160. The cross-sectional view of FIG. 2D is taken along line A-A in FIG. 1B through the midfoot region 112 of the sole structure 130. As illustrated, the midsole 140 includes a top surface 142 and a bottom surface 144 opposite the top surface 142. Furthermore, the first outsole 150 includes a top surface 250 and a bottom surface 240, the bottom surface 240 being configured to contact and support the article of footwear 10 on a support surface. The second outsole 160 further includes a top surface 290 and a bottom surface 292, the bottom surface 292 being opposite of the top surface 290. The cross-section is taken through the second and third sections 210, 220 of the midsole 140. More specifically, the cross-section is taken through the second segment 224 of the third section 220 of the midsole 140. In addition, the cross-section is further taken through the second and third sections 270, 280 of the first outsole 150, including the second segment 284 of the third section 280 of the first outsole 150. Furthermore, the cross-section is also taken through the second segment 232 of the second outsole 160.

When the first and second outsoles 150, 160 are coupled to the midsole 140, the top surface 250 of the first outsole 150 in the second section 270 of the first outsole 150 is coupled to the bottom surface 144 of the midsole 140 in the second section 210 of the midsole 140. In addition, the top surface 290 of the second outsole 160 is coupled to the bottom surface 144 of the third section 220 of the midsole 140, while the top surface 250 of the third section 280 of the first outsole 150 is coupled to the bottom surface 292 of the second outsole 160. As illustrated in FIG. 2D, the grooves 212 of the bottom surface 144 of the second section 210 of the midsole 140 are configured to receive the ridges of the top surface 250 of the second section 270 of the first outsole 150, while the grooves 272 of the top surface 250 of the second section 270 of the first outsole 150 are configured to receive the ridges of the bottom surface 144 of the second section 210 of the midsole 140. Thus, bottom surface 144 of the second section 210 of the midsole 140 is configured to complement and receive the top surface 250 of the second section 270 of the first section 150. While not illustrated, the bottom surface 144 of the first section 200 of the midsole 140 is configured to complement and receive the top surface 250 of the first section 260 of the first outsole 150 in a substantially similar or identical manner.

As further illustrated in FIG. 2D, the first outsole 150 may have varying thicknesses. As illustrated, the thickness T1 of the first midsole 150 at the grooves 272 of the second section 270 of the first midsole 150 may be approximately 1.5 mm, while the thickness T2 of the first midsole at the ridges of the second section 270 of the first midsole 150 may be approximately 3.0 mm. The grooves 262 and the ridges of the first section 260 may create varying thicknesses of the first section 260 that are substantially similar to those of the second section 270 of the first outsole 150. In addition, the second outsole 160 may have a thickness T3 of approximately 1.5 mm. Thus, the first outsole 150 at the third section 280 may have a thickness of 1.5 mm.

Figure 3A:
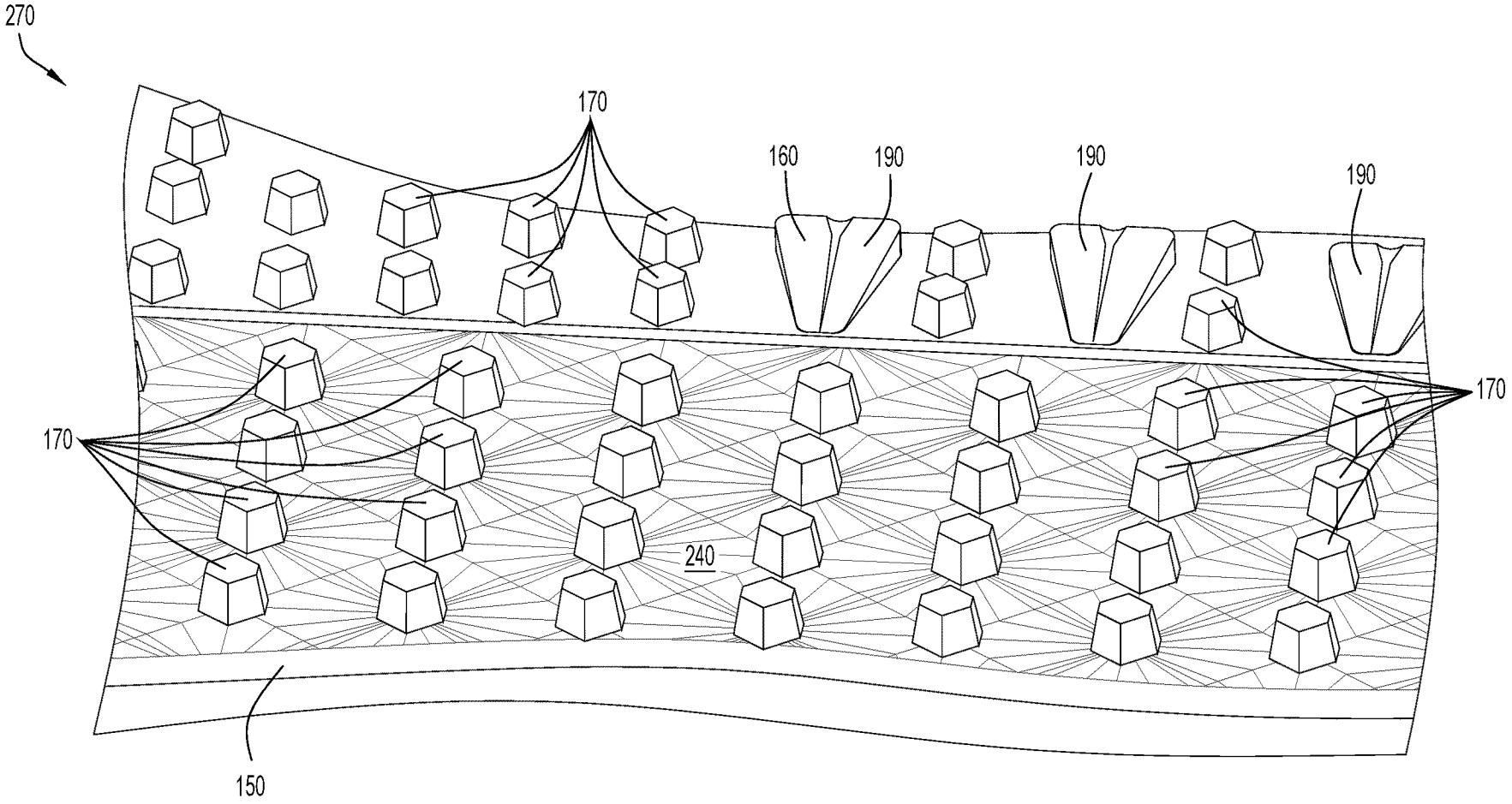
FIG. 3A illustrates a perspective view of the first type of lugs disposed on the lateral side of the embodiment of the article of footwear illustrated in FIG. 1A.
Figure 3B:
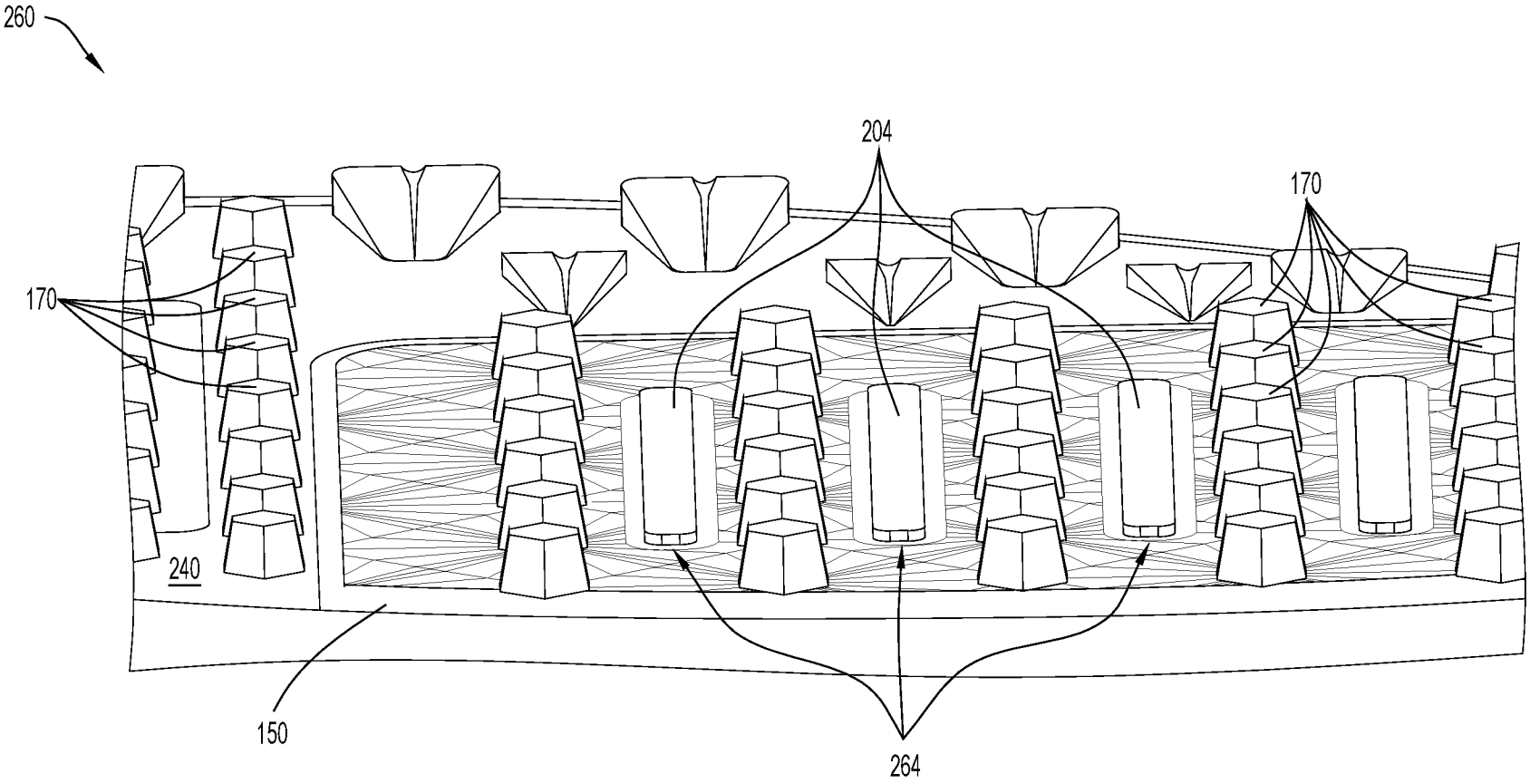
FIG. 3B illustrates a perspective view of the first type of lugs disposed on the medial side of the embodiment of the article of footwear illustrated in FIG. 1A.

As previously described herein, and as best illustrated in FIGS. 3A and 3B, the first set of lugs 170 are aligned in a series of rows and columns on the bottom surface 240 of the first midsole 150 such that the first set of lugs 150 extend downwardly from the bottom surface 240 of the first midsole 150. As illustrated, the first set of lugs 170 may be shaped similar to that of truncated cones. More specifically, in the embodiment illustrated in FIGS. 3A and 3B, the first set of lugs 170 may be shaped like that of a truncated hexagonal pyramid. In other embodiments, the first set of lugs 170 may be any other shape.

Figure 3C:
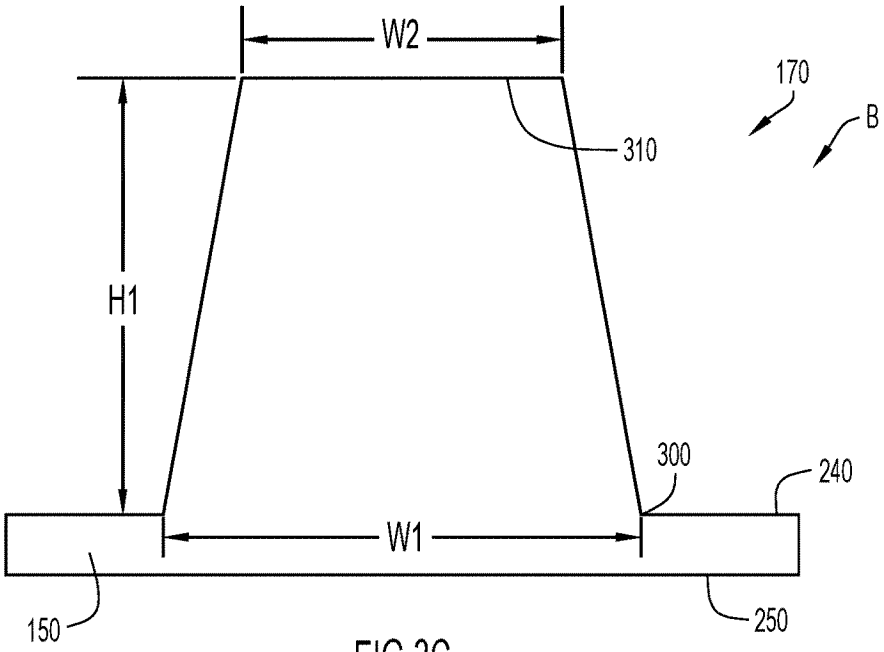
FIG. 3C illustrates a side elevational view of the first type of lug illustrated in FIGS. 3A and 3B, where the first type of lug is in an uncompressed state.
Figure 3D:
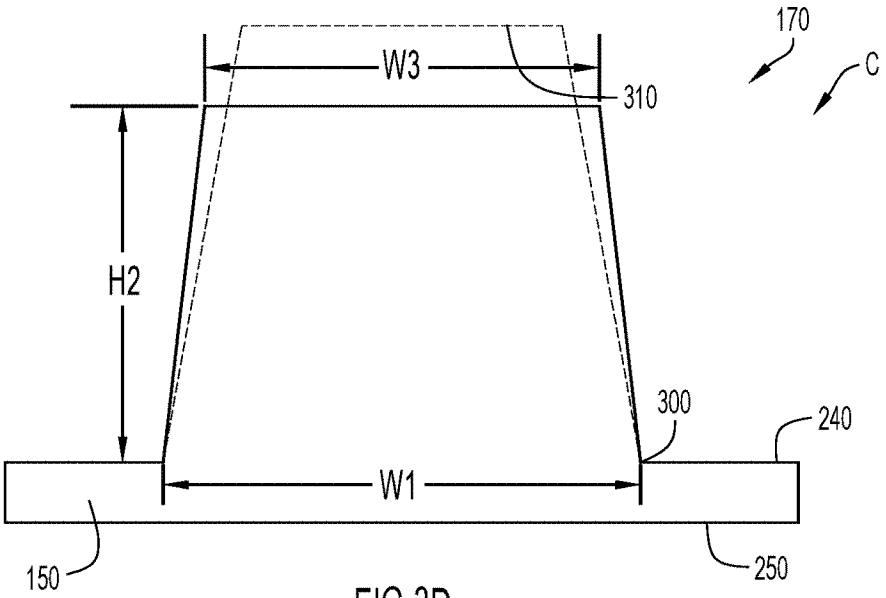
FIG. 3D illustrates a side elevational view of the first type of lug illustrated in FIGS. 3A and 3B, where the first type of lug in a compressed state.

Because the first set of lugs 170 are formed as part of the first outsole 150, which is constructed from a TPU with a soft durometer, the first set of lugs 170 are compressible, like that illustrated in FIGS. 3C and 3D. As illustrated, and as previously described herein, the lug 170 extends from the bottom surface 240 of the first outsole 150. Each lug 170 of the first set of lugs 170 has a base 300 and an end 310, where the base 300 is disposed proximate to the coupling of the lug 170 to the bottom surface 240 of the first outsole 150. The end 310 of the lug 170 is disposed opposite the base 300 and is configured to contact a support surface when the article of footwear 10 is disposed on a support surface. The base 300 of the lug 170 has a width W1. In one embodiment, the base width W1 of the lug 170 may be approximately 10.0 mm. In the uncompressed configuration B, the lug 170 has a first height H1, which is the length of the lug 170 from the base 300 to the end 310, or the distance from the end 310 of the lug 170 to the bottom surface 240 of the first outsole 150. Additionally, the end 310 of the lug 170 in the uncompressed configuration B has a second width W2. In one embodiment, the lug 170, when in the uncompressed configuration B may have a height H1 of approximately 6.5 mm, while the width W2 of the end 310 of the lug 170 may be 4.0 mm.

When the article of footwear 10 is pressed into the support surface, the soft TPU material of the first outsole 150 promotes compression of the first set of lugs 170, where the first set of lugs 170 compress from the uncompressed configuration B to the compressed configuration C. In the compressed configuration C, the base of the lug 170 may still retain the width W1. When the lug 170 is compressed, however, the height of the lug 170 shortens from H1 to a compressed height H2. Furthermore, compression may cause the width of the end 310 of the lug 170 to expand from uncompressed width W2 to compressed width W3, where compressed width W3 of the end 310 of the lug 170 may be larger than the uncompressed width W2, while still remaining smaller than the base width W1. In one embodiment, normal compression of the first set of lugs 170 may compressed the lugs from an uncompressed height H1 of 6.5 mm to the compressed height H2 of approximately 5.5 mm.

Returning to FIG. 3B, the elongate openings 264 are disposed between rows of the first set of lugs 170 on the first section 260 of the first outsole 170. As illustrated in FIG. 3B, the elongate protrusions 204 protrude through the elongate openings 264 such that the surface of the elongate protrusions 260 are aligned with the bottom surface 240 of the first outsole 150. As previously described herein, the first section 260 of the first outsole 150 and the first section 200 of the midsole 140 are disposed on the medial side 102 of the article of footwear 10. Exposing the midsole 140 through each of the elongate openings 260 increases the degree of flexure of the sole structure 130 on the medial side 102 of the article of footwear 10. This enables the medial side 102 of the article of footwear 10 to more easily bend and flex in the forefoot region 110, which enables the toe end 104 of the article of footwear to be more easily bent backwards (e.g., during walking, crouching, etc.). Creating more flexure in the forefoot region along the medial side 102 of the article footwear 10 also makes the article of footwear 10 more comfortable when performing movements while wearing the article of footwear 10 (e.g., walking).

Figure 4A:
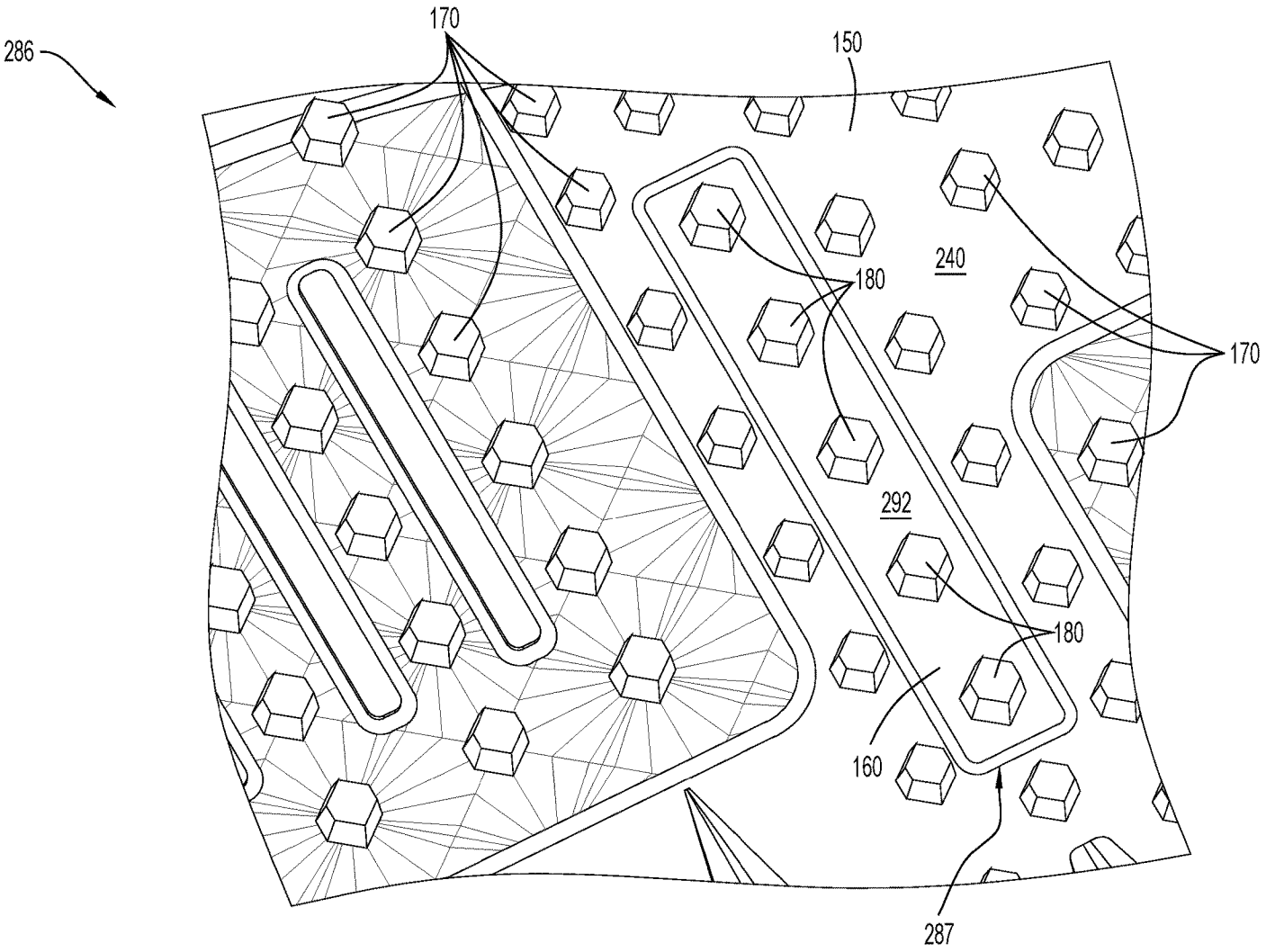
FIG. 4A illustrates a perspective view of a second type of lug disposed in the forefoot region of the embodiment of the article of footwear illustrated in FIG. 1A.

As best illustrated in FIG. 4A, the second set of lugs 180 extend through the aperture 287 in the first outsole 150. The second set of lugs 180 are aligned linearly within the aperture 287, and may be aligned or misaligned with the first set of lugs 170 disposed around the aperture 287. As illustrated, the second set of lugs 180 may be shaped substantially similar to that of the first set of lugs 170, where the second set of lugs 180 may be in the form of truncated cones. More specifically, in the embodiment illustrated in FIGS. 4A and 4B, the second set of lugs 180 may be shaped like that of a truncated hexagonal pyramid. In other embodiments, the second set of lugs 180 may be any other shape.

Figure 4B:
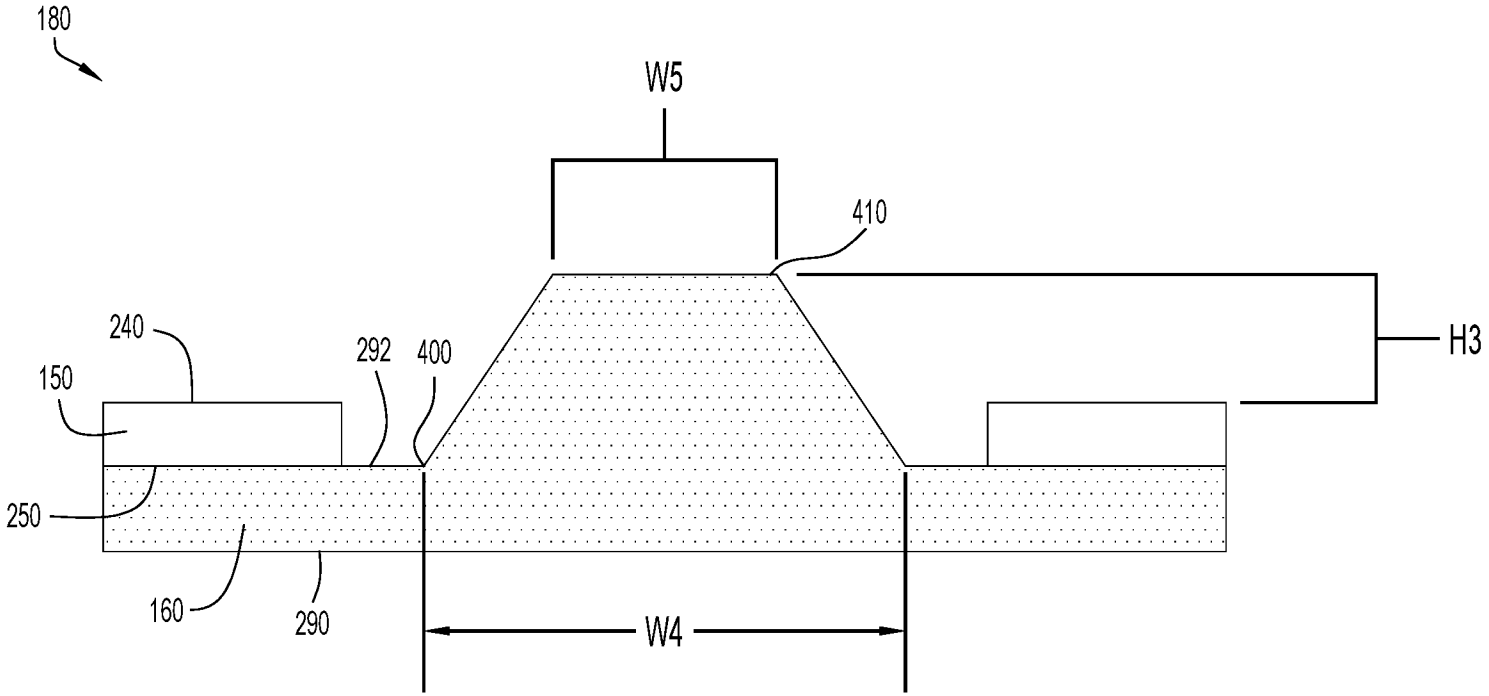
FIG. 4B illustrates a cross-sectional view of the second type of lug illustrated in FIG. 4A.

The second set of lugs are formed as part of the second outsole 160 and configured to extend from the bottom surface 292 of the second outsole 160. Unlike the first set of lugs 170, which are constructed from a TPU with a soft durometer, the second set of lugs 180 are constructed from a TPU with a hard durometer (i.e., a larger durometer value than the first set of lugs 170), and are not as compressible or are incompressible. As best illustrated in FIG. 4B, each lug 180 of the second set of lugs 180 has a base 400 and an end 410, where the base 400 is disposed proximate to the coupling of the lug 180 to the bottom surface 292 of the second outsole 160. The end 410 of the lug 180 is disposed opposite the base 400 and is configured to contact a support surface when the article of footwear 10 is disposed on a support surface. The base 400 of the lug 180 has a width W4. In one embodiment, the base width W4 of the lug 180 may be equal to the base W1 of the lug 170. Thus, the base width W4 of the lug 180 may be approximately 10.0 mm. The end 410 of the lug 180 may have a width W5 of approximately 4.0 mm. Furthermore, the lug 180 may have a height H3, which is the distance that the lug 180 extends from the bottom surface 240 of the first outsole 150, which serves as the bottom surface of the outsole 130. Thus, the height H3 is the distance between the end 410 of the lug 180 and the bottom surface 240 of the first outsole 150. In one embodiment, the height H3 of lug 180 may be approximately 5.5 mm. Thus, in the uncompressed configuration B, the first set of lugs 170 may extend 1.0 mm farther than the second set of lugs 180 from the bottom surface 240 of the first outsole 150, but may extend the same distance when in the compressed configuration C.

Figure 5A:
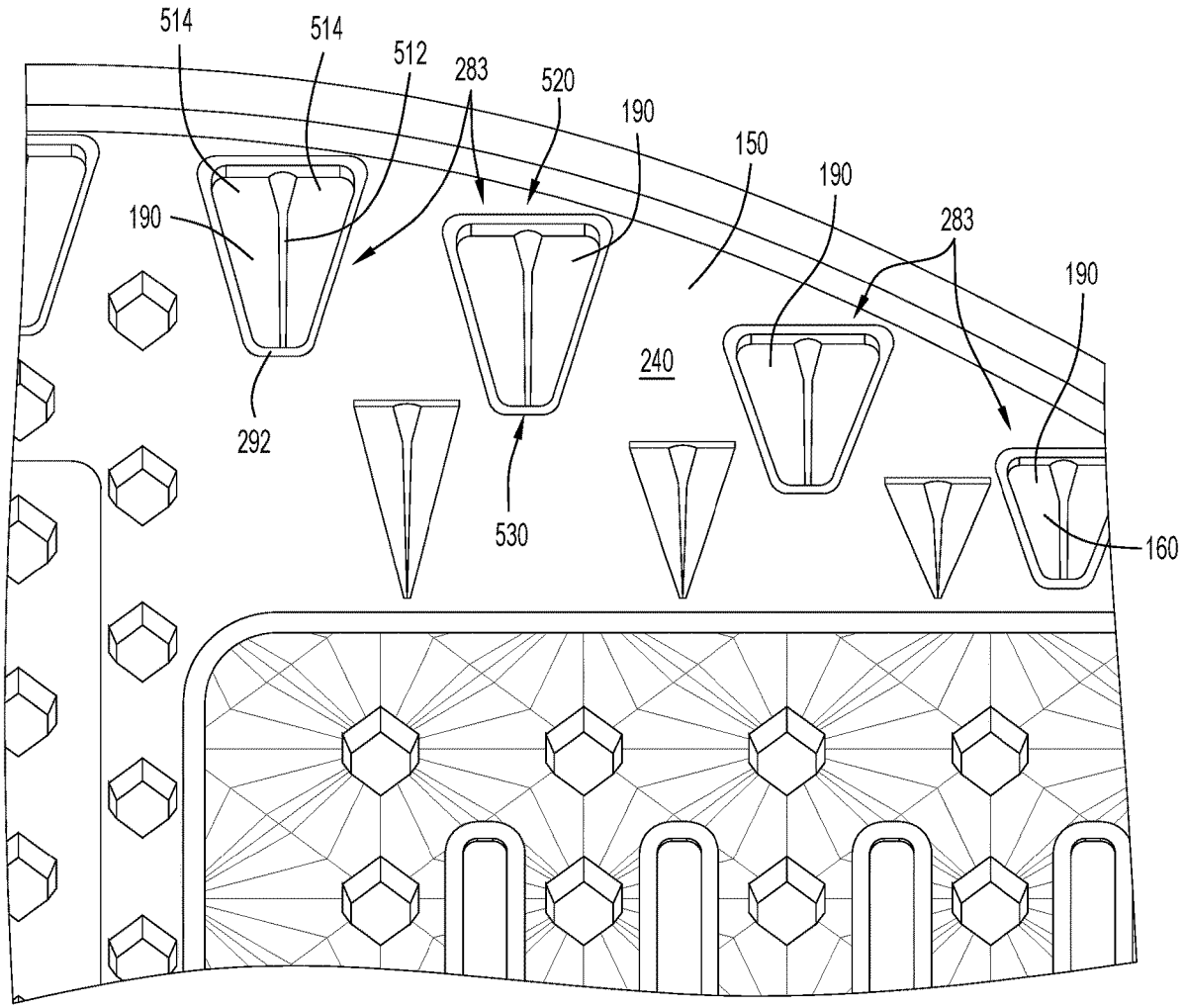
FIG. 5A illustrates a bottom view of the third type of lug disposed on the lateral side of the embodiment of the article of footwear illustrated in FIG. 1.
Figure 5B:
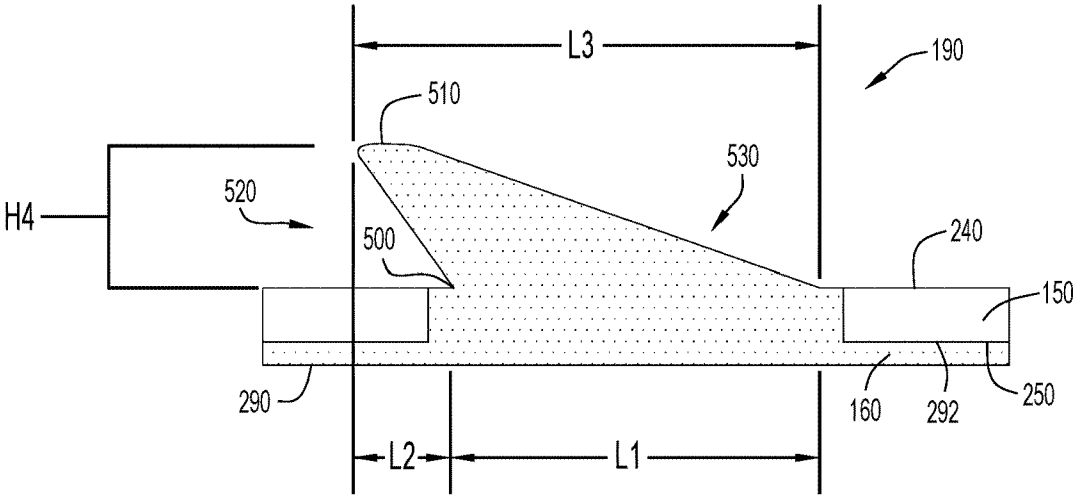
FIG. 5B illustrates an elevational view of the side of the third type of lug illustrated in FIG. 5A.
Figure 5C:
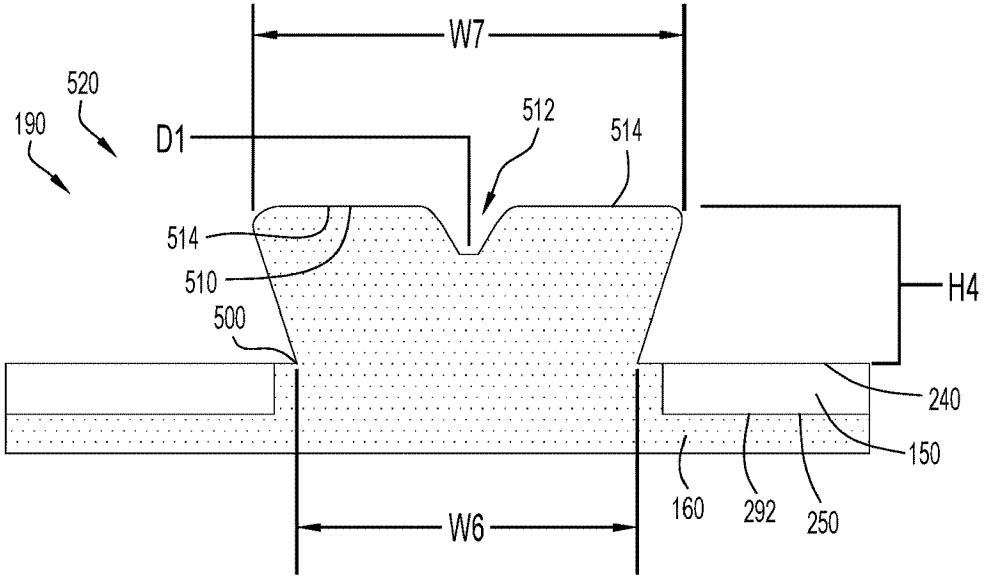
FIG. 5C illustrates an elevational view of the front of the third type of lug illustrated in FIG. 5A.

While FIG. 5A only illustrates the third set of lugs 190 that are disposed along the lateral side 100 of the article of footwear 10 in the forefoot region 110, the discussion of FIGS. 5A, 5B, and 5C also applies to the third set of lugs 190 that are disposed along the medial side 102 of the article of footwear 10 in the hindfoot region 114. As best illustrated in FIG. 5A, the third set of lugs 190 extend through the first openings 283 in the first outsole 150. As previously described, the third set of lugs 190 are disposed along the lateral and medial edges of the sole structure 130 of the article of footwear 10.

As illustrated in FIGS. 5A, 5B, and 5C, unlike the first and second sets of lugs 170, 180, the third set of lugs 190 are wedge-shaped. Similar to the second set of lugs 180, however, the third set of lugs 190 are formed as part of the second outsole 160 and configured to extend from the bottom surface 292 of the second outsole 160. Also similar to the second set of lugs 180, the third set of lugs 190 are constructed from a TPU with a hard durometer, and may be less compressible than the first set of lugs 170, or the third set of lugs 190 may be incompressible. As best illustrated in FIGS. 5B and 5C, each lug 190 of the third set of lugs 190 has a base 500 and an end 510, where the base 500 is disposed proximate to the coupling of the lug 190 to the bottom surface 292 of the second outsole 160. The end 510 of the lug 190 is disposed opposite the base 500 and is configured to contact a support surface when the article of footwear 10 is disposed on a support surface. The lug 190 further includes a front side 520 and a rear side 530. The front side 520 and the rear side 530 extend upwardly from the base in the same general direction, but offset from a normal of the bottom surface 292 of the second outsole 160. The front side 520 extends from the base 500 from a first point, while the rear side 530 extends from the base 500 from a second point that is spaced a distance L1 from the first point of the front side 520. In other words, the lug 190 has a length L1 proximate to the base 500 of the lug 190. As illustrated in FIG. 5B, the front side 520 and the rear side 530 converge to one another at end 510. This causes the end 510 of the lug 190 to be offset from base 500 of the lug 190, where the end 510 extends in a first direction from the base 500 a second length L2 such that the end 510 of the lug 190 may be disposed over a portion of first outsole 150. Thus, the lug 190 may have a total length L3, where L3 is the combination of length L2 and length L1. Each of the lugs 190 of the third set of lugs 190 may have different values of lengths L1, L2, and L3 based on the placement of the lug 190 on the sole structure 130 (e.g., lugs 190 disposed closer to the toe end 104 or heel end 106 may be smaller than lugs 190 disposed farther from the toe end 104 or heel end 106). Therefore, unlike the first and second set of lugs 170, 180, the third set of lugs 190 may not be uniform in size.

Each of the lugs 190 may have a base width W6 and a differing end width W7 on the front side 520 of the lug 190. As illustrated in FIG. 5C, the base width W6 may be smaller than the end width W8. FIG. 5A illustrates that both the base width W6 and the end width W7 taper from the front side 520 to the rear side 530 of the lug 190. Thus, when viewed from above, the lugs 190 are substantially triangular. Similar to the lengths L1, L2, L3, the base width W6 and end width W7 may vary for each lug 190 of the third set of lugs 190 based on the placement of the lug 190 on the sole structure 130. Furthermore, the lugs 190 may have a height H4, which is the distance that the lug 190 extends from the bottom surface 240 of the first outsole 150. Thus, the height H4 is the distance between the end 510 of the lug 190 and the bottom surface 240 of the first outsole 150. While the other dimensions of the lugs 190 may vary, the height H4 may be equal for each of the third set of lugs 190. In one embodiment, the height H4 of lug 190 may be approximately 5.5 mm. Thus, in the uncompressed configuration B, the first set of lugs 170 may extend 1.0 mm farther than the third set of lugs 190 from the bottom surface 240 of the first outsole 150, but the two sets of lugs 170, 190 may extend the same distance when the first set of lugs 170 are in the compressed configuration C.

As further illustrated in FIGS. 5A, 5B, and 5C, the lugs 190 contain a central channel 512 that spans the length L3 of the lug 190. Thus, the channel 512 is disposed within the end 510 and the rear side 530 of the lug 190. Similar to the lug 190, the channel 512 may taper in width along the length L3 of the lug 190, where the largest width of the channel 512 may be at the end 510 of the lug 190. The central channel 512 may have an initial depth of D1 at the end 510 of the lug 190, while the depth D1 of the channel 512 also tapers or reduces along the length L3 of the lug 190. In one embodiment, the depth D1 of the channel 512 may have a maximum value of 1.5 mm. The channel 512 creates two equally sized sectors 514 of the lug 190. While the third set of lugs 190 are not compressible like the first set of lugs 170, the channel 512 of the third set of lugs 190 may cause the two sectors 514 to flare outward when the third set of lugs 190 are pressed against a support surface, enabling the ends 510 of the third set of lugs 190 to catch, grab, and/or impart a frictional force onto a larger portion of the support surface.

By forming the sole structure 130 of the article of footwear 10 with a dual durometer outsole 150, 160 and placement of the cleats in directional patterns as described herein and as depicted in the figures, the traction of the article of footwear 10 is improved for the forces typically experienced by the article of footwear 10. As previously described herein, the softer durometer of first set of lugs 170 enables the first set of lugs 170 to compress when the first set of lugs 170 impact a support surface, or simply when a person places their weight on the sole structure 130. Because the first set of lugs 170 extend farther from the bottom surface 240 of the first outsole 150 than the second or third set of lugs 180, 190, the ends 310 of the first set of lugs 170 typically impact or contact the support surface prior to the ends 410, 510 of the second and third set of lugs 180, 190, respectively. This enables the first set of lugs 170 to provide additional cushion and comfort to the foot of a wearer of the article of footwear 10 during a typical gait. Furthermore, when compressed, the first set of lugs 170 may extend the same distance from the bottom surface 240 of the first outsole 150 as the second and third set of lugs 180, 190. The compressible properties permit compression of the first set of lugs 170 until the ends 310, 410, 510 of the first, second, and third sets of lugs 170, 180, 190, respectively, are all disposed within the same plane. Thus, when the sole structure is forced against a support surface (i.e., a wearer places their weight on the foot within the article of footwear 10), the ends 310, 410, 510 of the first, second, and third sets of lugs 170, 180, 190, respectively, will all be in contact with the support surface.

As previously described herein, the compressibility of the first set of lugs 170 also widens, or spreads, the ends 310 of the first set of lugs 170. In addition, the compressibility of the first set of lugs 170 may also enable the first set of lugs 170 to bend/move side to side. This promotes improved traction of the article of footwear 10 by keeping the bottom surface 240 of the first outsole 150 in contact with the ground for the longest amount of time (e.g., during various phases of a typical gait, shifting the weight of the user to different portions of the foot, etc.). For example, as a person shifts their weight on their foot from side to side or from back to front, the compressibility and bendability of the first set of lugs 170 may keep the ends 310 of the first set of lugs 170 in contact with the support surface.

The placement and shape of the third set of lugs 190 prevents the rotation and translation the article of footwear 10 across a support surface during a golf swing performed by the wearer of the article of footwear 10. The torque from swinging a golf club causes a person's leading foot (i.e., the left foot of a right handed golfer) to twist or rotate in position, where the toe end of the foot tends to flare out or rotate in the lateral side direction and the heel end of the foot tends to flare out or rotate in the medial side direction. The wedge-shaped third set of lugs 190 are configured to prevent movement in the direction in which the front side 520 of the third set of lugs 190 faces. Thus, placing one series of the third set of lugs 190 on the lateral side 100 of the forefoot region 110 and the second series of the third set of lugs 190 on the medial side 102 of the hindfoot region 114, as best illustrated in FIG. 1B, orients the two series of the third set of lugs 190 as being diametrically opposed to one another. The ends 510 of the third set of lugs 190 disposed on the lateral side 100 of the forefoot region 110 are oriented to be proximate to the lateral edge of the sole structure 130, while the ends 510 of the third set of lugs 190 disposed on the medial side 102 of the hindfoot region 114 are oriented to be proximate to the medial edge of the sole structure 130. Thus, when a person wearing the article footwear 10 swings a golf club, or performs another similar movement with their body and their feet, the ends 510 of the wedge shaped third set of lugs 190 are forced into the support surface (e.g., grass and/or dirt) and provide additional traction in order to prevent or obstruct the article of footwear 10 from rotating. The third set of lugs 190 disposed on the lateral side 100 of the forefoot region 110 prevent or obstruct the toe end 104 of the article of footwear 10 from rotating in the lateral side direction. Conversely, the third set of lugs 190 disposed on the medial side 102 of the hindfoot region 114 prevent or obstruct the heel end 106 of the article of footwear 10 from rotating in the medial direction. The first and second set of lugs 170, 180 are also in contact with the support surface during a golf swing, and further add to the traction created by the third set of lugs 190 to also aid in preventing or obstructing the article of footwear 10 from rotating. Furthermore, by being constructed from a harder, non-compressible or incompressible TPU material, the third set of lugs 190 are less likely to be wear or deteriorate during use of the article of footwear 10.

The second set of lugs 180, by being disposed along the ball of the foot disposed within the article of footwear 10 adds additional traction to the article of footwear 10 when both swinging a golf club and when walking. Especially when walking or standing, most of the weight of a user is placed on the balls of the feet of the user. By positioning the non-compressible second set of lugs in the region of the article of footwear 10 that aligns with the ball of a foot placed within the article of footwear 10, the second set of lugs 180 are more likely to be driven into the support surface when walking or performing golf maneuvers (e.g., swinging a golf club, crouching to read a green, etc.). Thus, the second set of lugs 180 provide additional traction to sole structure 130. In addition, by being constructed from a harder, non-compressible TPU material, the second set of lugs 180 are less likely to wear or deteriorate during use of the article of footwear 10.

The dual durometer sole structure 130 of the first outsole 150 and the second outsole 160 may be constructed by a double-shot process. The first and second outsole 150, 160 may be molded from a mold comprising a primary mold portion and a secondary mold portion. The first outsole 150 may be formed by the primary mold portion while the second outsole 160 may be formed by the secondary mold portion. As previously described herein, the second outsole 160 may be formed of a material having a hard durometer value, while the first outsole 150 may be formed of a material having a soft durometer value. The first outsole 150 may be molded around/over the bottom surface 292 of the second outsole 160 while also being molded around the second and third set of lugs 180, 190.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An article of footwear defining a forefoot region, a hindfoot region, a midfoot region between the forefoot and hindfoot regions, a lateral side, and a medial side, the article of footwear comprising:

a sole structure comprising an outsole that extends from the forefoot region to the hindfoot region; and a plurality of lugs formed integral with the outsole, wherein the plurality of lugs comprises:

a plurality of first lugs, each first lug having a first shape, wherein the first shape is defined by a first side of the first lug extending in a longitudinal direction of the first lug inward from a first end of the first lug to a second end of the first lug so as to be non-perpendicular with the first end of the first lug, the first shape is further defined by a second side of the first lug that opposes the first side of the first lug and extends in the longitudinal direction of the first lug inward from the first end of the first lug toward the second end of the first lug and also toward the first side of the first lug; and a plurality of second lugs, each second lug having a second shape that differs from the first shape;

wherein:

a first set of first lugs is located within the forefoot region proximate the lateral side, and each first lug of the first set is oriented on the outsole such that the longitudinal direction of each first lug of the first set extends between the lateral and medial sides of the article of footwear;

a second set of first lugs is located within the hindfoot region proximate the medial side, and each first lug of the second set is oriented on the outsole such that the longitudinal dimension of each first lug of the second set extends between the lateral and medial sides of the article of footwear;

a third set of second lugs is located within the forefoot region proximate the medial side;

a fourth set of second lugs is located within the hindfoot region proximate the lateral side: and the outsole comprises a first outsole layer and a second outsole layer overlying the first outsole layer such that the second outsole layer comprises an outer layer of the article of footwear, and the first lugs of the first set are secured to the first outsole layer and extend through openings in the second outsole layer.

2. The article of footwear of claim 1, wherein each of the first lugs has a wedge shape.

3. The article of footwear of claim 1, wherein each of the first lugs has a substantially triangular shape.

4. The article of footwear of claim 1, wherein the first end of each first lug of the first set is disposed more proximate to an outermost lateral edge of the lateral side than the second end of each first lug of the first set, and wherein the first end of each first lug of the second set is disposed more proximate to an outermost medial edge of the medial side than the second end of each first lug of the second set.

5. The article of footwear of claim 1, wherein:

the sole structure defines an edge;

the first set of first lugs includes at least one first lug oriented proximate the edge of the sole structure; and the second set of first lugs includes at least one first lug oriented proximate the edge of the sole structure.

6. The article of footwear of claim 1, wherein at least one first lug includes a central channel extending longitudinally along the at least one first lug, the channel spanning a length of the at least one first lug.

7. The article of footwear of claim 6, wherein:

the channel possesses a width that is transverse the length of the at least one first lug; and the width of the channel tapers along the length of the at least one first lug such that a wider portion of the channel is oriented at the first end of the at least one first lug.

8. The article of footwear of claim 7, wherein:

the channel possesses a depth that is transverse the width of the channel and the length of the at least one first lug; and the depth of the channel decreases along the length of the at least one first lug such that the depth is greater along the first end of the at least one first lug.

9. The article of footwear of claim 1, wherein each second lug has a hexagonal shape.

10. The article of footwear of claim 1, wherein:

the first outsole layer comprises a thermoplastic polyurethane possessing a first durometer; and the second outsole layer comprises a thermoplastic polyurethane possessing a second durometer, the second durometer being lower than the first durometer.

* * * * *